US008702873B2

(12) United States Patent
Shaffer et al.

(10) Patent No.: US 8,702,873 B2
(45) Date of Patent: Apr. 22, 2014

(54) CHLORINE GENERATING DEVICE AND RELATED DISHWASHER

(75) Inventors: Timothy Scott Shaffer, La Grange, KY (US); Ronald Scott Tarr, Louisville, KY (US); Matthew David Mersch, Louisville, KY (US); James Quentin Pollett, Louisville, KY (US); Kyle Kozinski, North Canton, OH (US)

(73) Assignee: General Electric Company, Schenectady, NY (US)

( * ) Notice: Subject to any disclaimer, the term of this patent is extended or adjusted under 35 U.S.C. 154(b) by 454 days.

(21) Appl. No.: 13/007,705

(22) Filed: Jan. 17, 2011

(65) Prior Publication Data

US 2012/0180825 A1 Jul. 19, 2012

(51) Int. Cl.
*B08B 3/00* (2006.01)

(52) U.S. Cl.
USPC ..... 134/56 D; 134/57 D

(58) Field of Classification Search
USPC ..... 134/56 D
See application file for complete search history.

(56) References Cited

U.S. PATENT DOCUMENTS

| | | | | |
|---|---|---|---|---|
| 3,711,385 | A * | 1/1973 | Beer | 205/464 |
| 4,147,558 | A | 4/1979 | Fraula et al. | |
| 4,147,559 | A | 4/1979 | Fraula et al. | |
| 4,209,343 | A | 6/1980 | Lane et al. | |
| 4,229,229 | A | 10/1980 | Churley et al. | |
| 4,285,352 | A | 8/1981 | McMahon et al. | |
| 6,719,891 | B2 | 4/2004 | Ruhr et al. | |
| 2006/0283789 | A1 | 12/2006 | Kadlec et al. | |
| 2006/0283808 | A1 | 12/2006 | Kadlec et al. | |
| 2006/0283809 | A1 | 12/2006 | Kilawee et al. | |
| 2007/0180866 | A1 | 8/2007 | Cao et al. | |
| 2009/0032409 | A1 | 2/2009 | Horn et al. | |
| 2009/0261045 | A1 | 10/2009 | Kilawee et al. | |

FOREIGN PATENT DOCUMENTS

| | | |
|---|---|---|
| EP | 1645681 | 4/2006 |
| WO | WO 2006/044951 | 4/2006 |

* cited by examiner

*Primary Examiner* — Jason Ko
(74) *Attorney, Agent, or Firm* — Dority & Manning, P.A.

(57) ABSTRACT

An electrolytic sanitizer is disclosed for use in a dishwasher holding a salt solution, the dishwasher having a water rinse cycle. A spaced anode and cathode are provided in contact with the salt solution in the dishwasher. A source of current provides a voltage across the anode and cathode to generate chlorine from the salt solution, the chlorine being introduced into the water rinse cycle to sanitize objects in the dishwasher. Related dishwasher designs are also disclosed.

10 Claims, 5 Drawing Sheets

CHLORINE GENERATING DEVICE AND RELATED DISHWASHER

FIELD OF THE INVENTION

The present disclosure relates generally to devices for generating chlorine, which can be used in sanitizing objects in a dishwasher.

BACKGROUND OF THE INVENTION

Most dishwashers use detergents to clean objects such as cookware placed therein. Various formulations of detergents have been introduced that provide excellent cleaning in such machines. For example, detergents often use non-ionic surfactants, usually along with water softeners, bleaches, enzymes, anti-bacterial agents, fragrances, coloring agents, and various other ingredients.

Many dishwashers now have a thermal sanitizing feature. For example, various dishwashers available from General Electric Corp. meet NSF/ANSI Standard 184, which requires that a dishwasher achieve a 99.999% reduction in bacteria when operating in its sanitizing cycle. Typically, in such a sanitizing cycle, water is heated to a more elevated temperature than used in normal cleaning for a certain period of time. For example, the sanitizing rinse must accumulate at least 3600 HUE (heat unit equivalents) points above 143 F to be considered sanitized. HUE points are established as a function of temperatures of 143 F or above within the NSF standard. Calculations are based on HUE's gathered per 1-second intervals. The NSF protocol requires a minimum of 3600 HUE's shall be accumulated at each of the monitored plate and glass locations in the dishwasher. If the temperature at any thermocouple location drops below 143 F, the accumulation of HUE's begins again at zero once the temperature returns to 143 F. Further, sanitizing rinse temperatures shall meet or exceed 150 F.

Such dishwashers with sanitizing cycles are very effective at reducing bacterial presence on objects in the dishwasher. However, the extra sanitizing cycle's increased temperature, water handling requirements, etc., use additional energy. Further, total dishwasher cycle time may be increased if such a sanitizing cycle is included.

Accordingly, other designs for devices and related dishwashers that can sanitize objects, including those addressing one or more drawbacks of conventional sanitizing cycles and dishwashers, would be welcome.

BRIEF DESCRIPTION OF THE INVENTION

Aspects and advantages of the invention will be set forth in part in the following description, or may be obvious from the description, or may be learned through practice of the invention.

According to certain aspects of the present disclosure, an electrolytic sanitizer is disclosed for use in a dishwasher holding a salt solution, the dishwasher having a water rinse cycle. A spaced anode and cathode are provided in contact with the salt solution in the dishwasher. A source of current provides a voltage across the anode and cathode to generate chlorine from the salt solution, the chlorine being introduced into the water rinse cycle to sanitize objects in the dishwasher. Various options and modifications are possible.

According to certain other aspects of the invention, a dishwasher includes a wash chamber and a salt solution holder for holding a salt solution. A spaced anode and cathode pair are provided in contact with the salt solution in the salt solution holder. A source of current provides a voltage across the anode and cathode to generate chlorine from the salt solution, the chlorine being introduced into the wash chamber during a rinse cycle to sanitize objects in the wash chamber. Again, various options and modifications are possible.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
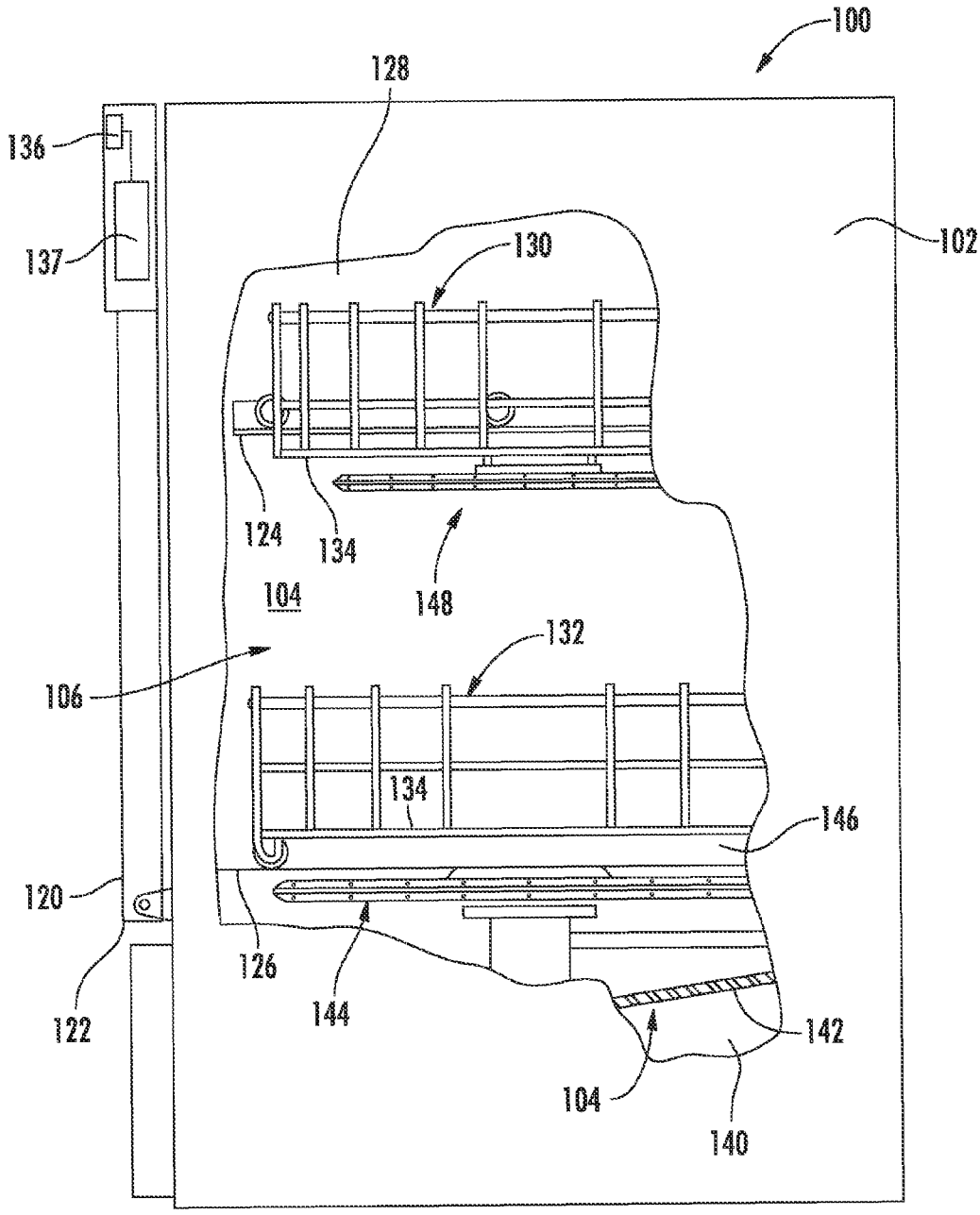
FIG. 1 provides a side partial cut-away view of an exemplary dishwasher that may be configured in accordance with aspects of the invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As discussed in greater detail below, embodiments of the present disclosure relate to an electrolytic device that can be used with a dishwasher to sanitize objects during a rinse cycle. FIG. 1 depicts an exemplary domestic dishwasher 100 that may be configured in accordance with aspects of the disclosure. For the particular embodiment of FIG. 1, the dishwasher 100 includes a cabinet 102 having a tub 104 therein that defines a wash chamber 106. The tub 104 includes a front opening (not shown in FIG. 1) and a door 120 hinged at its bottom 122 for movement between a normally closed vertical position (shown in FIG. 1) wherein the wash chamber 106 is sealed shut for washing operation, and a horizontal open position for loading and unloading of articles from the dishwasher. Upper and lower guide rails 124, 126 are mounted on tub side walls 128 and accommodate upper and lower roller-equipped racks 130, 132, respectively. Each of the upper and lower racks 130, 132 is fabricated into lattice structures including a plurality of elongate members 134, and each rack 130, 132 is adapted for movement between an extended loading position (not shown) in which the rack is substantially positioned outside the wash chamber 106, and a retracted position (shown in FIG. 1) in which the rack is located inside the wash chamber 106. A silverware basket (not shown) may be removably attached to the lower rack 132 for placement of silverware, utensils, and the like, that are too small to be accommodated by the upper and lower racks 130, 132.

The dishwasher 100 further includes a lower spray-arm-assembly 144 that is rotatably mounted within a lower region 146 of the wash chamber 106 and above a tub sump portion 142 so as to rotate in relatively close proximity to the lower rack 132. A mid-level spray-arm assembly 148 is located in an upper region of the wash chamber 106 and may be located in close proximity to upper rack 130. Additionally, an upper spray arm assembly (not shown) may be located above the upper rack 130.

The lower and mid-level spray-arm assemblies 144, 148 and the upper spray arm assembly are fed by a fluid circulation assembly for circulating water and dishwasher fluid in the tub 104. The fluid circulation assembly may be located in a machinery compartment 140 located below the bottom sump portion 142 of the tub 104, as generally recognized in the art. Each spray-arm assembly includes an arrangement of discharge ports or orifices for directing washing liquid onto dishes or other articles located in the upper and lower racks 130, 132, respectively. The arrangement of the discharge ports in at least the lower spray-arm assembly 144 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or other configuration of dishwasher, and that the embodiment depicted in FIG. 1 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles.

Figure 2:
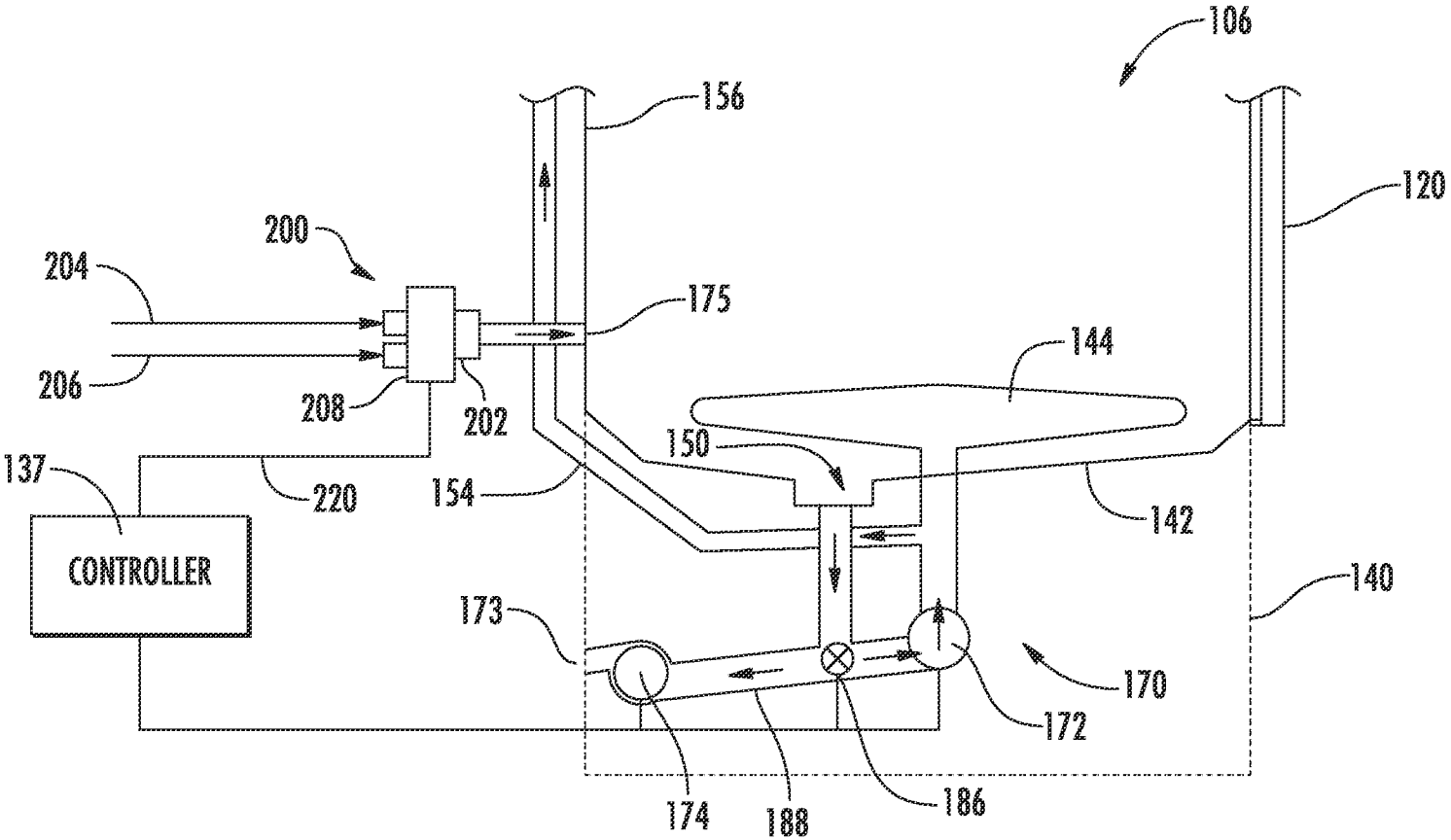
FIG. 2 is a schematic view of one possible fluid system the dishwasher of FIG. 1.

FIG. 2 illustrates an embodiment of a fluid circulation assembly 170 configured below the wash chamber 106. Although one embodiment of a fluid circulation assembly that is operable to perform in accordance with aspects of the disclosure is shown, it is contemplated that other fluid circulation assembly configurations may similarly be utilized without departing from the spirit and scope of the invention. The fluid circulation assembly 170 includes a circulation pump assembly 172 and a drain pump assembly 174, both in fluid communication with the sump 150. Additionally, the drain pump assembly 174 is in fluid communication with an external drain 173 to discharge used wash liquid. Further, the circulation pump assembly 172 is in fluid communication with lower spray arm assembly 144 and conduit 154 which extends to a back wall 156 of wash chamber 106, and upward along the back wall 156 for feeding wash liquid to the mid-level spray arm assembly 148 (FIG. 1) and the upper spray arm assembly. This configuration also applies to a drawer-type of dishwasher, as mentioned above.

As wash liquid is pumped through the lower spray arm assembly 144, and further delivered to the mid-level spray arm assembly 148 (FIG. 1) and the upper spray arm assembly (not shown), washing sprays are generated in the wash chamber 106, and wash liquid collects in the sump 150. The sump 150 may include a cover to prevent larger objects from entering the sump 150, such as a piece of silverware or another dishwasher item that is dropped beneath lower rack 132. A course filter and a fine filter (not shown) may be located adjacent the sump 150 to filter wash liquid for sediment and particles of predetermined sizes before flowing into the sump 150. Furthermore, a turbidity sensor may be coupled to the sump 150 and used to sense a level of sediment in the sump 150 and to initiate a sump purge cycle where the contents or a fractional volume of the contents of the sump 150 are discharged when a turbidity level in the sump 150 approaches a predetermined threshold. The sump 150 is filled with water through an inlet port 175, as described in greater detail below.

In one embodiment, a drain valve 186 is established in flow communication with the sump 150 and opens or closes flow communication between the sump 150 and a drain pump inlet 188. The drain pump assembly 174 is in flow communication with the drain pump inlet 188 and may include an electric motor for pumping fluid at the inlet 188 to an external drain system via drain 173. In one embodiment, when the drain pump is energized, a negative pressure is created in the drain pump inlet 188 and the drain valve 186 is opened, allowing fluid in the sump 150 to flow into the fluid pump inlet 188 and be discharged from fluid circulation assembly 170 via the external drain 173.

Referring to FIG. 2, a water supply 200 may be configured with the inlet port 175 for supplying wash liquid to the wash chamber 106. The water supply 200 may provide hot water only, cold water only, or either selectively as desired. As depicted, water supply 200 has a hot water inlet 204 that receives hot water from an external source, such as a hot water heater and a cold water input 206 that receives cold water from an external source. It should be understood that the term "water supply" is used herein to encompass any manner or combination of valves, lines or tubing, housing, and the like, and may simply comprise a conventional hot or cold water connection.

Figure 3:
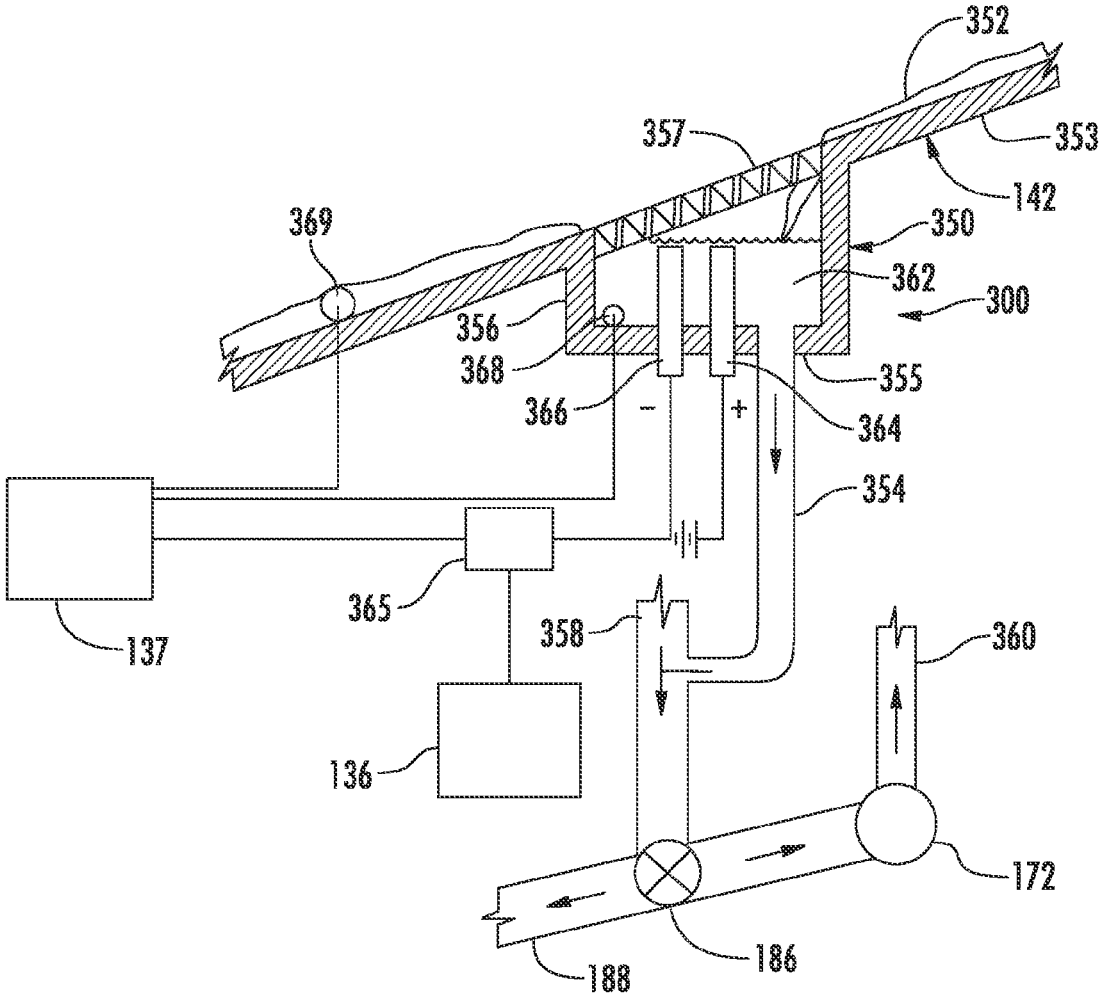
FIG. 3 provides a partial cross-sectional view of a dishwasher as in FIGS. 1 and 2, showing one example of an electrolytic sanitizer according to certain aspects of the present disclosure.

FIG. 3 shows one example of an electrolytic sanitizer 300 according to certain aspects of the disclosure. As shown therein, sanitizer 300 is attached to a sump compartment 350 of bottom wall 142 of wash chamber 106. Sump compartment 350 as shown is a separate dedicated sump for the sanitizer 300, which can be connected to main sump 150 described above. Alternatively, sump 350 could be the same structure used as main sump 150.

As shown, water 352 flows down wall 353 into sump 350 which is a somewhat cup shaped compartment, although any shaped could be employed. A drain 354 connected to a bottom wall 355 of sump compartment 350 can be used to empty the sump compartment. Side wall 356 of sump compartment 350 spaces bottom wall 355 from wall 142 of wash chamber thereby defining the volume of the sump compartment. A grate 357 keeps food particles out of compartment 350 but lets water through. As shown, drain 354 joins drain 358 connected to main sump (not shown in FIG. 3), and the outlet of both drains flows downward toward drain valve 186. Circulation pump 172 can draw liquid from drains 354 and 358 and pump it back into wash chamber 106 via conduit 360 if valve 186 is opened accordingly, as described above. Alternatively, the outflow of both drains 354 and 358 could be sent to drain pump inlet 188, as also described above.

Sump compartment 350 holds water 362 sufficient to functionally cover an anode 364 and a cathode 366 electrically connected to controller 137. Anode 364 and cathode 366 may be configured to receive a DC voltage potential or an AC voltage potential with known electronic controls 365. Accordingly, the anode and cathode may act as an electrolytic device. The anode and cathode may be made from metals such as titanium with corrosion resistant coatings such as rhodium oxide, for example. Other known materials, with or without coatings, are possible. The best candidates exhibit excellent electrical conduction, while maintaining acceptable corrosion resistance. Of ten times, a porous membrane is placed between the anode and cathode to retard the tendency of the three products —$Cl_2$, NaOH, and $H_2$ to recombine back together. Rather than applying the additional cost of the membrane and its assembly between the terminals, it could be elected to simply allow the process to be less efficient in producing stable sterilizing agents.

A salt solution of some sort is created within wash chamber 106 and accordingly within sump compartment 350. Accordingly, compartment 350 serves as a salt solution holder. The salt solution may be created in several ways. For example, the salt solution could be added by a user, just as detergent is, whether before each wash or in bulk to be metered by dishwasher as needed. Alternatively, solid salt could be added (rather than a solution). The salt may be common NaCl or other salts that include chloride or chloride ions. As known, electrolytic reactions in a salt solution at the anode and cathode respectively are: $2H_2O+2e^- \rightarrow 2OH^-+H_2$ and $2NaCl \rightarrow 2Na^++Cl_2+2e^-$. Accordingly, $Cl_2$ is created in the electrolysis of NaCl.

It takes approximately 0.21 grams of chlorine to provide a 50 ppm level in a 1.25 gallon water solution. To generate 0.21 grams of chlorine from a salt solution of any level that contains at least 1 gram of salt with the proposed embodiment, approximately 10.5 watt-hours of electrical energy must be applied. The time to reach this level of applied energy is affected by many variables such as the salt solution percentage (the higher the solution the higher the conductivity and the more ability to pull energy into the solution quickly), gaps between the terminals (the smaller the gap, the higher the ability to pull energy through the solution quickly), applied voltage levels (the higher the voltage, the faster the energy application rate) and surface area of the terminals (the larger the area, the faster the energy application rates).

In the embodiment proposed, if the water within the wash chamber during the rinse cycle is a salt solution of approximate concentration of 0.16%, the terminals are 1-inch by 1-inch, and the gap between the terminals is 0.25-inches, applying 12V DC across the anode and cathode for approximately 90 seconds, a chlorine level of between about 50 and about 200 ppm can be achieved. If efforts were taken to maintain separation of the byproducts, as mentioned above, and the gaseous byproducts in solution within the salt solution holder were retained better, the time to generate a chlorine level of 50 to 200 ppm could be achieved in 9 to 10 seconds assuming voltage level, salt solution and geometry is otherwise the same. The proposed method of generating chlorine is approximately 10% efficient. Fortunately, little chlorine is needed to properly sterilize the rinse water and its contents. Typically, the volume of water used in a rinse cycle is just over a gallon (about 1.2 gallons in the above example). Once such a chlorine level is reached, only a short continuation of the rinse cycle is needed to distribute the chlorinated water throughout the wash chamber and to sanitize the contents. For example, treatment for approximately 7 seconds in the example above would ensure the chlorinated water contacted all contents sufficiently and would comply with NSF standards established for commercial dishwashers that used chlorinated solutions such as sodium hypochlorite-water mixtures (bleach).

Figure 5:
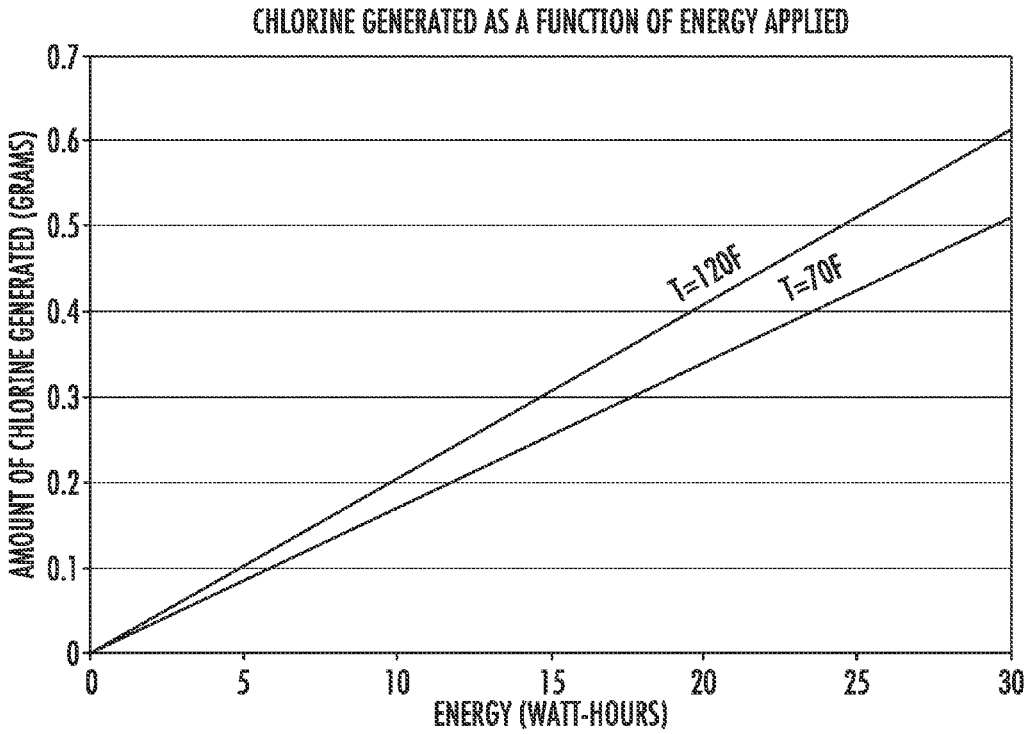
FIG. 5 provides a graph illustrating chlorine generation per energy applied.

FIG. 5 illustrates the amount of Chlorine generated as a function of energy applied, in solutions at two different temperatures. The device of the present disclosure can be optimized as desired in a given application to produce the amount of Chlorine needed for sterilization.

If desired sensors may be provided to assist with controlling the above reactions. As shown, sensors 368 and 369 are provided respectively in sump 350 and in wash chamber 106. Sensors in one or both of these locations could be employed to measure salinity or chlorine levels, which can be communicated to controller 137. If salinity is not high enough to create enough chlorine, more salt or salt solution can be provided automatically or a user could be prompted to do so, or sanitizing could be canceled from the wash cycle. Similarly, voltage could be provided across the anode and electrode until the chlorine level reaches a certain desired point. The user may use the interface panel 136 to indicate whether sanitizing is desired. The dishwasher 100 may use such panel 136 to indicate to a user if such cycle will occur, if supplies are sufficient, etc.

Figure 4:
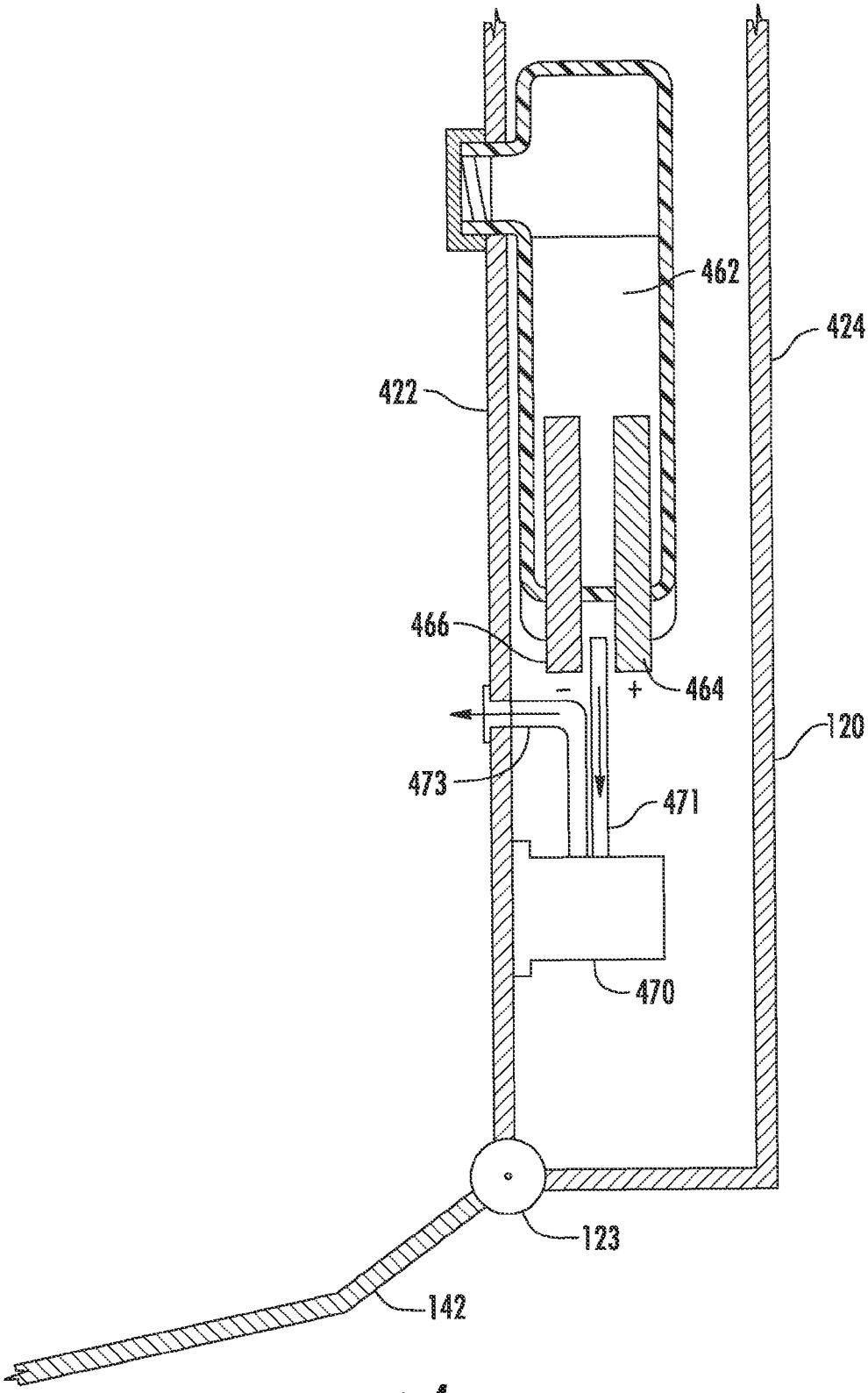
FIG. 4 provides a partial cross-sectional view of a dishwasher as in FIGS. 1 and 2, showing another example of an electrolytic sanitizer according to certain other aspects of the present disclosure.

FIG. 4 shows an alternate embodiment of an electrolytic sanitizer 400. As shown therein, salt solution holder 450 is a holding tank and is not simply a sump portion of wash compartment 106 as above. As shown, door 120 is attached to wall 142 by hinge 123. Holder 450 is located within door 120 (between panels 422 and 424), but it should be understood that holder 450 could be attached to an inner surface of panel 422 or elsewhere inside wash compartment 106 if desired. A removable cap 451 is provided to allow a user to refill holder 450 with salt solution. Anode 464 and cathode 466 extend into solution 462 within holder 450.

As above, voltage is provided across the anode and cathode to create a chlorinated solution. Pump 470 can draw the solution out of drain 471 and pass it into wash chamber 106 via outlet 473. Once the chlorine solution is within wash chamber 106, pump 172 can circulate the solution sufficiently to sanitize the contents as above.

In this embodiment, a higher concentration of chlorine in holder 450 is possible to minimize the amount of fluid expelled from the holder each cycle, to accordingly reduce the requirement for a user to refill the holder. If desired, a higher salt solution level is also possible. Therefore, chlorine may be generated at levels such as about 500 to about 57000 ppm within holder 450 so as to reduce refilling requirements. Enough solution is pumped into wash chamber 106 to reach the sanitizing levels above, namely about 50 to about 200 ppm. Holder 450 may be made from a blow molded plastic, for example, that is resistant to the chlorine and salt solution. Venting may be employed to reduce pressure within holder 450 in case of excess gases being created by the electrolysis. Sensors may be provided as above within wash chamber 106 and/or within holder 450 to detect salt solution level and/or chlorine levels, as above, with appropriate controls and feedback. In this embodiment, the chlorine could be generated during the wash cycle or in advance and stored.

In view of the above, various types of electrolytic sanitizers for dishwashers and the dishwashers themselves can be envisioned. Levels of solution and chlorine can be predetermined and can vary based on numerous factors such as rinse volume, time, current, voltage or voltage type, temperature, provided solution level, electrode size, spacing, and configuration, etc. Accordingly, the examples above and numerical information are intended to be exemplary only. Various applications may depart from the numerical examples above within the scope of the present invention. Substantial energy, water and time savings can be achieved using a chlorinated sanitizing cycle as compared to current heat-based sanitizing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher comprising:

a tub defining a wash chamber and having a bottom wall;

a salt solution holder for holding a salt solution, the salt solution holder positioned at the bottom wall of the tub and defining an interior volume;

a gate positioned between the wash chamber of the tub and the interior volume of the salt solution holder;

an anode positioned at the interior volume of the salt solution holder, the anode comprising titanium and a rhodium oxide coating, the rhodium oxide coating of the anode being in contact with the salt solution;

a cathode positioned at the interior volume of the salt solution holder and spaced from the anode, the cathode comprising titanium and a rhodium oxide coating, the rhodium oxide coating of the cathode being in contact with the salt solution in the salt solution holder; and a source of current to provide a voltage across the anode and cathode to generate chlorine from the salt solution, the chlorine being introduced into the wash chamber during a rinse cycle to sanitize objects in the wash chamber.

2. The dishwasher of claim 1, wherein the chlorine is generated during each use of the dishwasher by providing the voltage for a sufficient period of time to generate enough chlorine to sanitize the objects.

3. The dishwasher of claim 2, wherein the voltage is applied until the chlorine solution level reaches a range of about 50 to about 200 ppm within the salt solution within the wash chamber.

4. The dishwasher of claim 1, wherein the salt solution is formed at least in part by dissolved NaCl.

5. The dishwasher of claim 1, wherein the salt solution is at a solution level of up to about 0.16%.

6. The dishwasher of claim 1, wherein the salt solution holder is a salt solution compartment separate from the wash chamber.

7. The dishwasher of claim 6, wherein the voltage is applied until the chlorine solution level reaches a range of about 500 to about 57000 ppm within the salt solution within the salt solution compartment.

8. The dishwasher of claim 1, further comprising a porous membrane positioned between the anode and the cathode.

9. The dishwasher of claim 1, further comprising a sensor positioned at the interior volume of the salt solution holder or the wash chamber of the tub, the sensor configured for measuring a salinity level or a chlorine level.

10. The dishwasher of claim 1, wherein the interior volume of the salt solution holder is vented to the wash chamber of the tub through the grate.

* * * * *